United States Patent [19]

Fluck

[11] 4,024,381

[45] May 17, 1977

[54] ARTICLE COUNTING AND GROUPING APPARATUS

[75] Inventor: René Fluck, Neuhausen am Rheinfall, Switzerland

[73] Assignee: SIG Schweizerische Industrie-Gesellschaft, Neuhausen am Rheinfall, Switzerland

[22] Filed: July 22, 1976

[21] Appl. No.: 707,703

[30] Foreign Application Priority Data

Aug. 4, 1975 Switzerland ..... 10155/75

[52] U.S. Cl. ..... 235/92 PK; 235/92 PE; 235/92 R; 235/98 C; 198/444

[51] Int. Cl.[2] ..... G06M 7/06; G06M 3/02

[58] Field of Search ..... 235/92 PK, 92 PE, 92 SB, 235/98 R, 98 C; 198/444, DIG. 11

[56] References Cited

UNITED STATES PATENTS

| | | | |
|---|---|---|---|
| 3,665,444 | 5/1972 | Scott | 235/92 PK |
| 3,717,751 | 2/1973 | Fluck | 235/92 PK |

*Primary Examiner*—Joseph M. Thesz
*Attorney, Agent, or Firm*—Spencer & Kaye

[57] ABSTRACT

An apparatus for counting and grouping articles has a discharge end through which the articles are discharged in consecutive groups, each having a predetermined number of articles; a first conveyor carrying the articles in random distribution; a second conveyor having a plurality of parallel-arranged counting channels; a transfer arrangement for advancing the articles onto the counting channels from the first conveyor; a counter associated with each counting channel to monitor, from a zero count, the total number of articles passing the counter in the second conveyor to determine article groups having a predetermined number of articles; and a third conveyor having pusher assemblies associated with each counting channel for cyclically taking over the conveyance of the articles from the second conveyor at a location which is downstream of the counter as viewed in the conveying direction of the articles. The apparatus further includes an arresting device which, in the event an incomplete group is present in the counting channels, blocks the advance of the articles towards the discharge end and a switch-over device which sets the pusher assemblies into a withdrawn, inoperative state in the presence of such incomplete group. The arresting device allows the articles to proceed and the pusher assemblies are placed into their normal, article-engaging state when, as sensed by the counter, the incomplete group — by continuing conveyance on the second conveyor — reaches the predetermined number of articles.

5 Claims, 4 Drawing Figures

ARTICLE COUNTING AND GROUPING APPARATUS

BACKGROUND OF THE INVENTION

This invention relates to a counting and grouping apparatus for uniformly shaped, preferably flat articles, such as biscuits, or cookies and is of the type which has an input conveyor belt, which is charged with the articles at random locations and intervals. At the output of the apparatus the articles emerge in groups, each formed of a predetermined number of articles. Subsequently, the article groups, each containing an identical number of articles, may be wrapped, preferably after arranging the articles of each group in a stack.

An apparatus of the above-outlined type is disclosed in U.S. Pat. No. 3,717,751 which is incorporated herein by reference. The apparatus disclosed in this patent has a plurality of parallel-arranged channels, each provided with a conveyor device equipped with article-pusher members. The latter actuate a control arrangement which, in conjunction with an adding device, monitors the groups to determine whether each group has the desired number of items. Upon detection of an incomplete group, the control arrangement prevents a further conveyance of such group. In case, upon actuation of the control arrangement — which may be, for example, a switching device — a group is incomplete, an emergency stop signal is generated which energizes braking devices for preventing further advance of the articles, resets the adding device into the zero position and causes an alarm to be sounded for the operating personnel. It is a possibility, however, that the operating personnel would not immediately heed or become aware of the alarm signal. Thus, in case such emergency stop signals are generated more frequently under unfavorable operational conditions — or in case of an impermissible increase of the article-conveying cycle — significant idle periods may occur.

SUMMARY OF THE INVENTION

It is an object of the invention to provide an improved apparatus of the above-outlined type from which the stated disadvantages are eliminated.

This object and others to become apparent as the specification progresses, are accomplished by the invention, according to which, briefly stated, the apparatus for counting and grouping articles, has a discharge end through which the articles are discharged in consecutive groups, each having a predetermined number of articles; a first conveyor carrying the articles in random distribution; a second conveyor having a plurality of parallel-arranged counting channels; a transfer arrangement for advancing the articles onto the counting channels from the first conveyor; a counter associated with each counting channel to monitor, from a zero count, the total number of articles passing the counter in the second conveyor to determine article groups having a predetermined number of articles; and a third conveyor having pusher assemblies associated with each counting channel for cyclically taking over the conveyance of the articles from the second conveyor at a location which is downstream of the counter as viewed in the conveying direction of the articles. The apparatus further includes an arresting device which, in the event an incomplete group is present in the counting channels, blocks the advance of the articles towards the discharge end and a switch-over device which sets the pusher assemblies into a withdrawn, inoperative state in the presence of such incomplete group. The arresting device allows the articles to proceed and the pusher assemblies are placed into their normal, article-engaging state when, as sensed by the counter, the incomplete group — by continuing conveyance on the second conveyor — reaches the predetermined number of articles.

DESCRIPTION OF THE PREFERRED EMBODIMENTS

Figure 1:
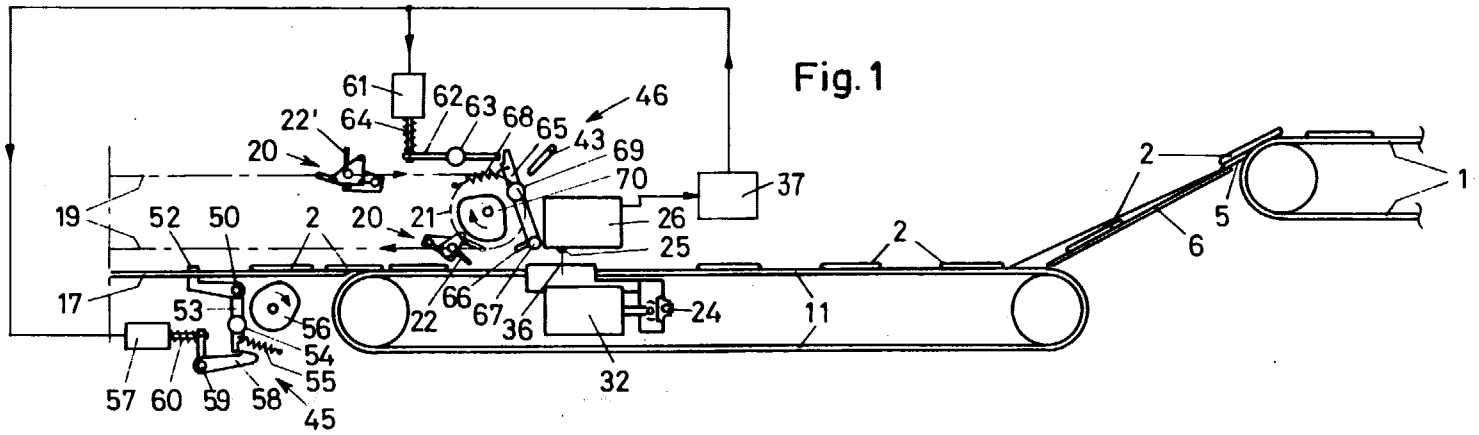
FIG. 1 is a schematic side elevational view of a preferred embodiment of the invention.
Figure 2:
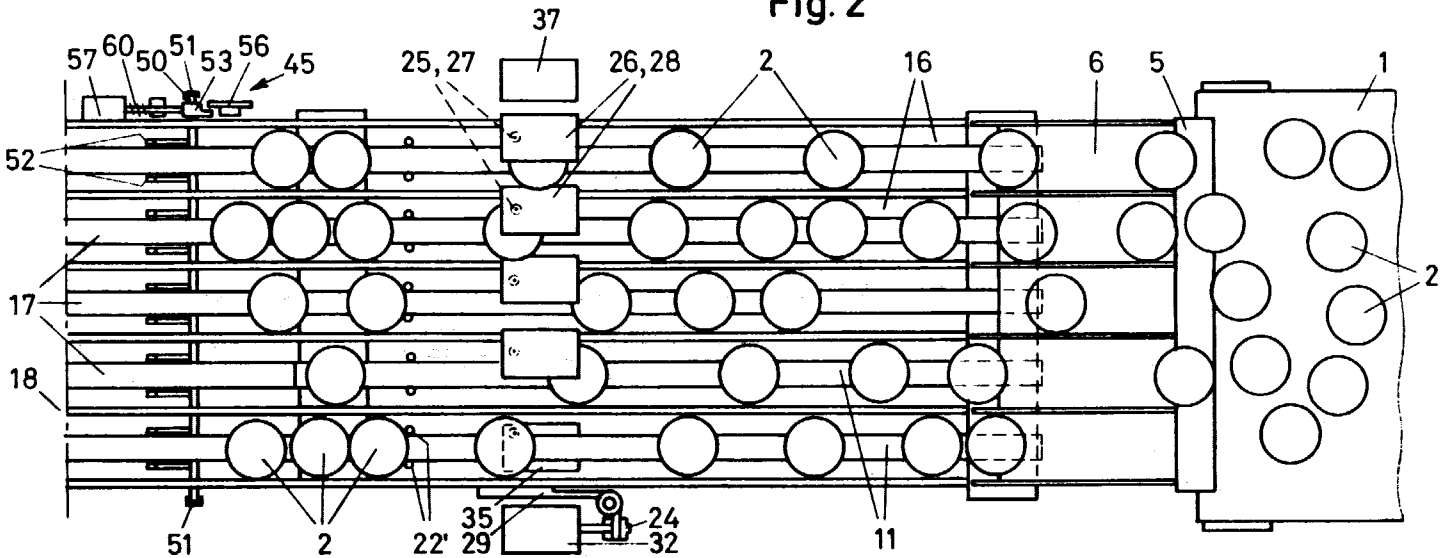
FIG. 2 is a schematic top plan view of the structure shown in FIG. 1.

Turning to FIGS. 1 and 2, the counting and grouping apparatus shown therein includes a wide input conveyor belt 1 to which there are advanced articles, for example, cookies 2 from a furnace (not shown) in a randomly distributed manner. By means of a transverse stripper bar 5 the articles 2 are wiped off the belt 1 and are, on a slide 6, advanced to five parallel-arranged counting channels 16 in which the articles are further conveyed by individual conveyor belts 11. In each channel 16 there is arranged a light barrier device 36 comprising a transmitter 26 which includes a light source 25 and a receiver 28, which includes a photocell 27. The interruption or restoration of the light beam of each light barrier device 36 serves for counting the articles 2 in the respective channel 16. For this purpose, in each counting channel 16 there is arranged a longitudinal counter 35 which counts the articles that pass by the light barrier device 36 in the respective channel. Further, there is provided a common transverse counter 37 which periodically, and at very short time intervals, monitors the state of the longitudinal counters 35 and adds their counts. With the channels 16 there are further associated braking devices 24, each having a brake shoe 29 that may be actuated by an associated electromagnet 32. The electromagnets 32 are, as a function of the information in the longitudinal counters 35, controlled in such a manner by the transverse counter 37 that in case the number of articles in a group to be conveyed in the channels 16 has reached a predetermined number, the braking devices 24 prevent further articles from being added to the group that had passed the light barrier devices 36. The conveyor belts 11 advance the articles 2 onto slides 17, above which there is positioned an endless chain 19 provided with pusher assemblies 20 and driven by chain sprockets 21. Each pusher assembly 20 has two pusher fingers 22 which, as indicated at 22', when projecting outwardly in a direction perpendicular to the chain 19 and oriented downwardly (position A, FIG. 3), engage bilaterally a trailing peripheral portion of an article 2 positioned on the belt 11 and push the article on and along the respective slide 17 to the discharge end 18 of the apparatus. In the zone of the conveyor device 19 and 20, which, in FIG. 2, is indicated merely by the finger 22' of the one pusher assembly 20, there is positioned a stationary key or switch member 43, which is actuated by the pusher assemblies 20 as they move past the key 43 so that the key 43 may, for example, close and then re-open an electric circuit.

In the apparatus disclosed in the above-noted U.S. Pat. No. 3,717,751 (and which, up to this point of the present description, is identical to the apparatus designed according to the invention), the key 43 serves for triggering an emergency stop signal. This signal is triggered, if at the moment at which the key 43 is actuated by a pusher assembly 20 (which, immediately thereafter, would take over the conveyance of an article 2 passing through the light barrier device 36), an insufficient number of articles 2 are present in the counted group. In case the group has the predetermined number of articles, which normally is the case, the adding devices 35, 37 prevent the triggering of the emergency stop signal. In case an emergency stop signal is generated, all brake shoes 29 are brought into their actuated position by virtue of the energization of the associated electromagnets. Further, the transverse counter 37 is reset to its zero position and the operating personnel are alerted by an optical and/or acoustic signal.

Since each emergency stop signal causes a significant interruption in production, the counting and grouping apparatus according to the invention is structured in such a manner that no emergency stop signals are generated, but the incomplete article groups are completed in the successive article-conveying cycle, that is, during the time interval which lasts from the moment of the actuation of the key 43 by a pusher assembly 20 (which means that one group is incomplete) until the actuation of the key 43 by an immediately succeeding pusher assembly 20.

For performing the above-noted completion of groups that lack the predetermined number of articles, the apparatus is, according to the invention provided with an arresting device 45 and a switch-over device 46. The arresting device 45 holds up the incomplete article groups while the switch-over device 46 switches the pusher fingers 22 into a withdrawn position B (FIG. 3) that is, into a position in which they are incapable of advancing any article 2. The distance of the arresting device 45 from the light barrier devices 36 (which are illustrated in the drawing on a relatively reduced scale for better overall visibility of the structure) has to be large enough to permit the formation of groups having the predetermined number of articles.

The arresting device 45 comprises a shaft 50 which is arranged transversely to the parallel slides 17 and the ends of which are supported in bearings 51 and which is further provided with stop arms 52 for arresting the articles 2. Adjacent one of the bearings 51, a control arm 53 is attached to the shaft 50. The control arm 53 carries a follower roller 54 which, in turn, is urged by a tension spring 55 towards a cam disc 56 which is driven, in a manner not shown, synchronously with the sprockets 21.

An electromagnet 57 of the arresting device 45 pivots, when energized, a pawl 58 counterclockwise (as viewed in FIG. 1) about a pin 59 against the force of a compression spring 60, so that the pawl 56 engages a lever 53 and immobilizes the same against the force of the tension spring 55 in the position shown in FIG. 1. At this time the stop arms 52 are in a position in which they arrest, with their upwardly projecting ends, the articles 2 advanced from the belts 11 onto the slides 17. Upon de-energization of the electromagnet 57, the compression spring 60 pivots the pawl 58 clockwise, thus releasing the lever 53. As a result, the tension spring 55 moves the follower roller 54 into contact with the shallow part of the cam disc 56 so that the stop arms 52 are withdrawn downwardly to a sufficient extent to clear the path for the articles 2. The current which serves for energizing the electromagnet 57 is interrupted (by the counting devices 35, 37) every time an article group which has passed the optical light barrier devices 36 is complete in number. As the continuously rotating cam disc 56 engages with its high (elevated) portion the follower roller 54, the lever 53 and the stop arms 52 are, while the key 43 is contacted by a pusher assembly 20, brought into the arresting position for a short period of time. This occurrence, however, has no effect in case the groups are complete. Should this, however, not be the case, the electromagnet 57 is energized and the stop arms 52 remain in their locking position. In this case, however, the pusher assemblies 20 are switched over into their withdrawn (inoperative) position.

The switch-over device 46 causes, when in an operative position, the pusher fingers 22 to pivot into their withdrawn (inoperative) state. For this purpose the switch-over device 46 is provided with an electromagnet 61 which, in its energized state, pivots a pawl 62 clockwise about a pin 63 against the force of a compression spring 64, so that it engages, with its upper end, a control lever 65. The lever 65 which is provided with a receiving (runup) portion 66 and which is supported at its lower end by a pivot 67, is biased by a tension spring 68. The latter urges a follower roller 69, secured to the lever 65, towards a cam disc 70 which, in turn, is fastened to the rotary shaft of that sprocket 21 which is situated in the zone of the belts 11. The purpose of the cam disc 70 will be explained later.

Figure 3:
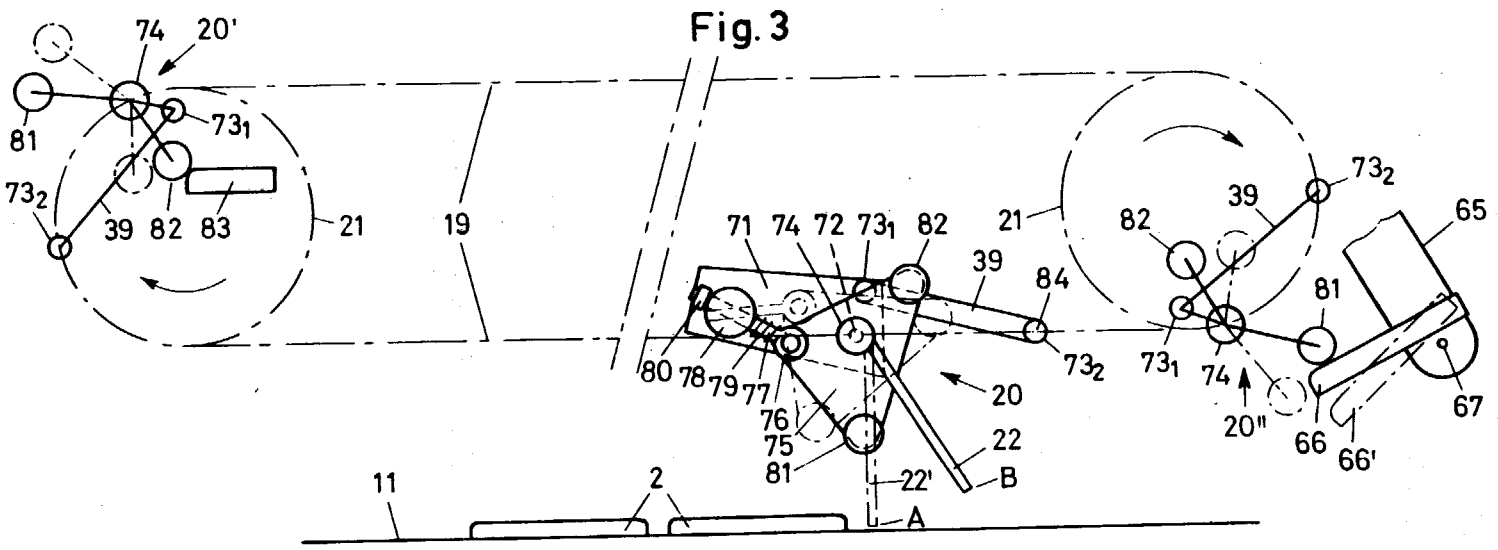
FIG. 3 is a schematic side elevational view, on an enlarged scale, of a detail of FIG. 1.
Figure 4:
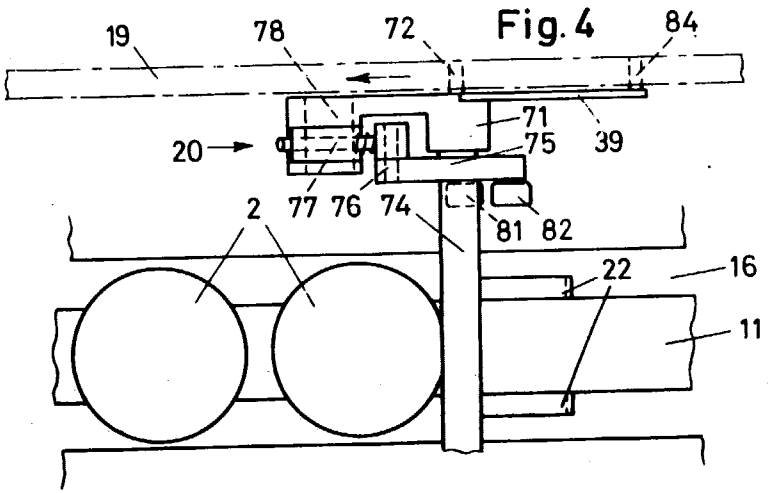
FIG. 4 is a schematic top plan view of a detail of FIG. 3.

Turning now to FIGS. 3 and 4, each pusher assembly 20 has a body 71 which is pivotally secured to the chain 19 by means of a pin 72. A control component 39 is, at its ends $73_1$ and and $73_2$, articulated to the body 71 and the chain 19, respectively. A shaft 74 which extends transversely to the channels 16 and to which the pusher fingers 22 are secured, is pivotally attached to the body 71 in axial alignment with the pin 72. To the body 71 there is fixedly secured an approximately triangular snap rocker 75. The snap rocker 75 supports, in one corner thereof, a rotatable pin 76 to which there is attached, in perpendicular orientation thereto, an eye bolt 77 which is displaceable in a transverse bore of a further pin 78 pivotally supported in the body 71. The eye bolt 77 supports a compression spring 79 which exerts a pressing force on the body 71 and the snap rocker 75. The distance between the two pins 76 and 78 is determined by an abutment nut 80 threadedly mounted on the free terminus of the eye bolt 77. At the other two corners of the snap rocker 75 there are arranged two runup rollers 81 and 82 which cooperate with the runup portion 66 affixed to the lever 65 of the switch-over device 46 and, respectively, with a stationary receiving portion 83 arranged on the zone of that sprocket 21 which is remote from the belts 11.

In an end position of the snap rocker 75 which is shown in solid line in FIG. 3, the direction of the pressing force of the spring 79 passes under the shaft 74 and the pusher fingers 22 are in their inoperative (withdrawn) position B. If the snap rocker 75 is pivoted clockwise, as viewed in FIG. 3. until the directiion of the pressing force of the spring 79 passes above the shaft 74, the snap rocker 75 moves rapidly into its other, dash-dotted end position in which the pusher fingers 22 are in their operative advanced position A as indicated at 22'.

If the pusher assembly 20, upon passing the fixed runup member 83, is in its withdrawn position B designated at 20', the roller 82 runs up on the part 83 and pivots (trips) the snap rocker 75 clockwise, so that it assumes its operative position A. Thus, each pusher assembly 20 arrives slowly in an operative state A into the zone of the controlled runup component 66. The position 66' (shown in dash-dot lines in FIG. 3) of the runup component 66 corresponds to the normal operational situation, that is, the groups are complete in number as the pusher assembly 20 arrives into the zone of the runup component 66, as designated at 20''. In this case the pusher assembly 20 remains in its operative position A. If the runup member 66 is, on the other hand, in its full-line position (FIG. 3), the latter causes the roller 81 to travel up on the runup member 66, thus the snap rocker 75 is pivoted (tripped) counterclockwise and the pusher assembly 20, together with the pusher fingers 22, are brought into the inoperative position B. The adding device 35, 37 continues to operate without interruption so that during the successive conveying cycle the groups will be completed. Thus, as the successive pusher assembly 20 (or a subsequent one) passes the controlled runup member 66, the latter is in its withdrawn position 66'. As a result, the pusher assemblies 20 can now convey the completed article groups on the slides 17 (unobstructed by the arresting device 45) to the discharge zone 18 or farther, for example, to a stacking station. It is noted that the control component 39 of each pusher assembly 20 has significance only in connection with such a stacking device but has no role in the apparatus forming the subject of this invention. It is further noted that the cam disc 70 provides that the controlled runup member 66 can be brought into its withdrawn position 66' only if behind the last-counted article 2 there is sufficient place available to insure that the pusher fingers 22 can be introduced therebehind without danger of crushing the article.

It will be understood that the above description of the present invention, is susceptible to various modifications, changes and adaptations, and the same are intended to be comprehended within the meaning and range of equivalents of the appended claims.

What is claimed is:

1. In an apparatus for counting and grouping articles, including a discharge end through which the articles are discharged in consecutive groups, each having a predetermined number of articles; a first conveyor means carrying the articles in random distribution; a second conveyor means having a plurality of parallel-arranged counting channels; transfer means for advancing the articles onto the counting channels from said first conveyor means; counting means associated with each counting channel to monitor, from a zero count, the total number of articles passing the counting means in the second conveyor means to determine article groups having a predetermined number of articles; and a third conveyor means having pusher assemblies associated with each counting channel for cyclically taking over the conveyance of the articles from the second conveyor means at a location which is downstream of the counting means as viewed in the conveying direction of the articles; the improvement comprising a. an arresting device disposed downstream of said counting means, said arresting device having an operative position in which it blocks advance of the articles to said discharge end of said apparatus; said arresting device having an inoperative position in which it allows passage of the articles to said discharge end; said arresting device being operatively connected to said counting means for placing said arresting device in its operative position when an article group that passed said counting means has articles of less than the predetermined number and for placing said arresting device in its inoperative position when the article group blocked by it has reached said predetermined number; and b. a switch-over device disposed in the travelling path of said pusher assemblies; said switch-over device having an operative position in which it sets said pusher assemblies into a withdrawn state; in the withdrawn state said pusher assemblies remain out of contact with the articles during a conveying cycle; said switch-over device having an inoperative position in which it allows said pusher assemblies to remain in an advanced state; in the advanced state said pusher assemblies contact and convey said articles during a conveying cycle; said switch-over device being operatively connected to said counting means for placing said switch-over device in its operative position when an article group that passed said counting means has articles of less than the predetermined number and for placing said switch-over device in its inoperative position when the article group blocked by said arresting device has reached said predetermined number.

2. An apparatus as defined in claim 1, wherein said third conveyor means comprises an endless chain means to which said pusher assemblies are attached; said pusher assembly having pusher fingers affixed to a shaft pivotally supported in said pusher assembly; a snap rocker affixed to said shaft for rapidly pivoting said shaft to displace said pusher fingers as a unit into a withdrawn position and into a withdrawn position and into an article-engaging advanced position and tripping means disposed in the travelling path of said pusher assembly for exerting a pivoting force on said snap rocker.

3. An apparatus as defined in claim 2, wherein said tripping means comprises a stationary runup member for pivoting said an snap rocker to displace said pusher fingers into said advanced position and a movable runup member arranged spaced from said stationary runup member, said movable runup member forming part of said switch-over device; said movable runup member, when said switch-over device is in its said operative position, pivoting said snap rocker to displace said pusher fingers into said withdrawn position.

4. An apparatus as defined in claim 1, wherein said arresting device includes an electromagnet maintaining, as long as energized, said arresting device in its said operative position; said electromagnet being operatively coupled to, and being energized and de-energized by, said counting means.

5. An apparatus as defined in claim 1, wherein said switch-over device includes an electromagnet maintaining, as long as energized, said switch-over device in its said operative position; said electromagnet being operatively coupled to, and being energized and de-energized by, said counting means.

* * * * *